United States Patent [19]

Wyatt

[11] 4,192,437

[45] Mar. 11, 1980

[54] PIN-HOOK DISPENSING AND INSERTING OR SETTING TOOL

[76] Inventor: James L. Wyatt, 32700 Coastsite Dr., Rancho Palos Verdes, Calif. 90274

[21] Appl. No.: 881,200

[22] Filed: Feb. 27, 1978

[51] Int. Cl.[2] ..... B65H 3/00

[52] U.S. Cl. ..... 221/255; 221/312 A

[58] Field of Search ..... 221/255, 312 A

[56] References Cited

U.S. PATENT DOCUMENTS

| | | | |
|---|---|---|---|
| 3,209,947 | 10/1965 | Trujillo | 221/255 X |
| 3,332,598 | 7/1967 | Niel | 221/255 UX |
| 3,570,710 | 3/1971 | Bauer | 221/255 |

*Primary Examiner*—David A. Scherbel

*Attorney, Agent, or Firm*—Albert M. Herzig; Edward C. Walsh

[57] ABSTRACT

The drapery and pin-hook dispensing and inserting tool is of a pistol grip type construction having a pin-hook chamber for a charge of pin hooks for gravity feed without a separate magazine. At the position of the handle or grip is a thumb actuated pin-hook feeder or dispenser and inserter. The pin-hook chamber is internally configurated to conform to the contour of pin-hooks so as to hold a line of pin hooks in position for dispensing. The chamber is provided with a hinged door so that a fresh charge or supply of pin-hooks can be inserted as a unit to be held in the chamber by its internal configuration and the configuration on the inside of the door. The handle or grip preferably is at a 90° angle to the chamber.

9 Claims, 8 Drawing Figures

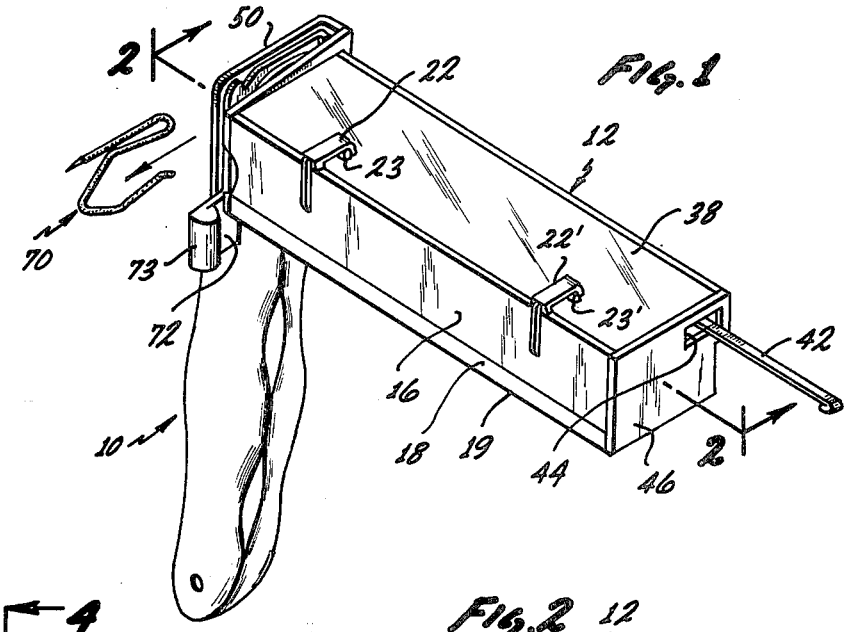
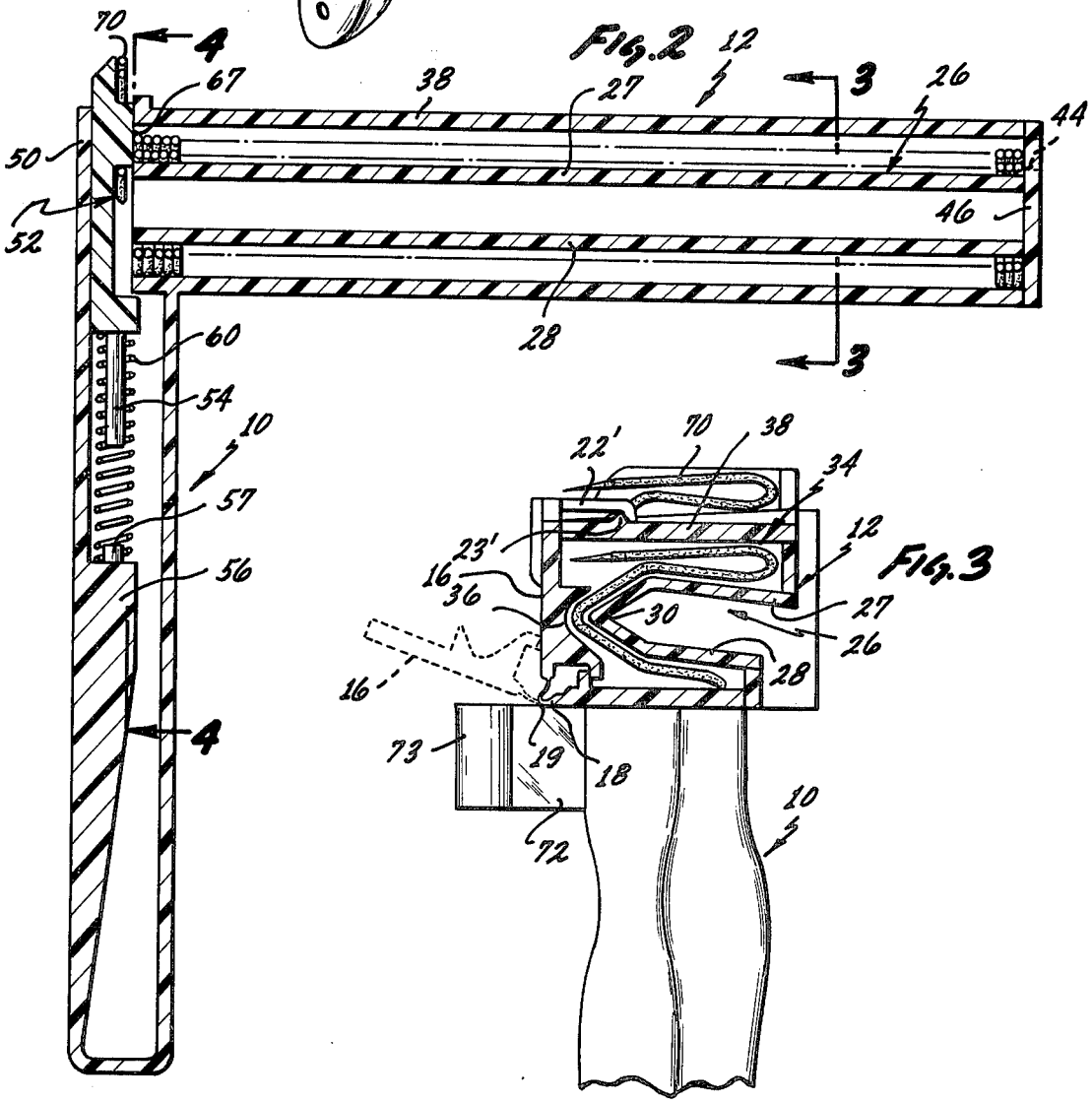
Fig. 3

PIN-HOOK DISPENSING AND INSERTING OR SETTING TOOL

BACKGROUND OF THE INVENTION

1. Field of the Invention

The field of the invention is that of drapery pin-hook dispensers and inserters, that is, tools for dispensing and setting the pin hooks in drapery material.

2. Description of the Prior Art

Various tools of the type of the invention are known in the prior art. The known prior art tools leave room for improvement in various aspects. Prior patents include the following numbers: U.S. Pat. Nos. 2,888,680; 2,903,696; 2,939,147; 2,951,249; 3,040,328; 3,332,598; 3,347,360; 3,381,811; 3,570,710; 3,546,981; 3,712,509, and Re. 24,929.

A particular aspect in which the prior art patents leave room for improvement is that relating to the loading of the pin-hooks and holding them in the tool. Most prior art tools require a separate magazine and in some of them the magazine is movable. Such magazines or cartridges typically use quantities of plastic that require molding and they represent an ecological disposal problem. Otherwise, the prior art lacks the capability of adequately holding the pin-hooks in position in the tool.

Another aspect in which there has been room for improvement has been in the constructional arrangement of the tool as respects the handle or grip and the capability of the tool to be able to facilitate drapery pinning operations. A further aspect in which there has been room for improvement is that of the capacity of the tool that is the pin-hook chamber or magazine for holding the pin-hooks.

The invention as described herein fulfills the need for all of the improvements referred to and otherwise provides improvements as described in detail hereinafter.

SUMMARY OF THE INVENTION

The tool of the invention is a manually operated tool provided with a grip or handle contoured to fit the fingers in a natural position when holding the handle. This improves the comfort of the pinner (usually women) and provides a more positive grip than a smooth un-contoured handle and reduces fatigue. The tool has an elongated pin-hook chamber with a handle or grip attached to one end. The entire tool can readily be constructed by way of platic injection molding processes.

The interior of the pin-hook chamber has a particular configuration or contour shaped to conform to the contour of the drapery pin-hooks within the chamber. The chamber has a hinged door through which a group or charge of pin-hooks held on a removable spindle can be inserted into the chamber, the pin-hooks being held on the removable spine or spindle inserted through the eyes in the pin-hooks.

At one end of the chamber is the integral handle or grip. The pin-hook ejector or dispenser is at this end, the feed of the pin-hooks being by gravity into the ejector or dispenser. This member is biased by a spring in the handle or grip and is operable by a thumb trigger.

In light of the foregoing a primary object of the invention is to provide an improved drapery hook pin-hook tool for dispensing and inserting or setting drapery pin-hooks.

A further object is to make available a tool as in the foregoing having a pin-hook chamber without a separate magazine, the pin-hook chamber having an internal configuration providing a contour conformable to the contour of the pin-hooks for holding them and the chamber having an openable door so that a group or charge of pin-hooks can be inserted and held as a unit in the chamber.

A further object is to make available a tool as in the foregoing wherein improved capacity of the pin-hook chamber is realized, that is more pin-hooks can be held in a chamber of equivalent size reducing the frequency of loading and increasing pinning time.

A further object is to realize a tool of contoured grip type having an improved configuration that fits the hand of the user with a grip at an angle of substantially 90° relative to the pin-hook chamber to facilitate drapery pinning operations.

Further objects and additional advantages of the invention will become apparent from the following drawings and detailed description.

BRIEF DESCRIPTION OF THE DRAWINGS

FIG. 1 is an isometric view of the preferred form of the invention;

FIG. 2 is a sectional view taken along the line 2—2 of FIG. 1;

FIG. 3 is a sectional view taken along the line 3—3 of FIG. 2;

DESCRIPTION OF THE PREFERRED EMBODIMENTS

Figure 4:
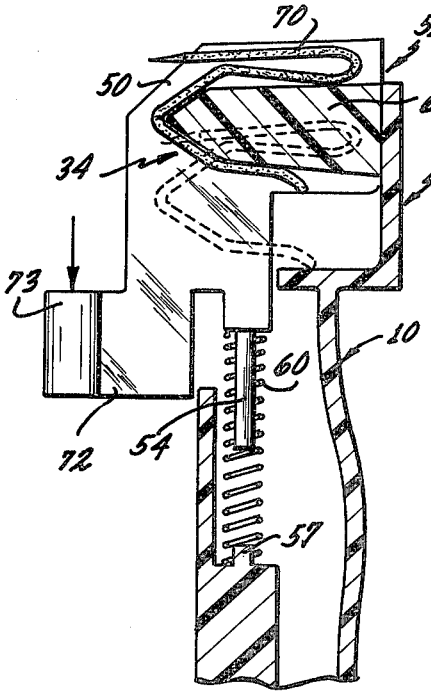
FIG. 4 is a sectional view taken along the line 4—4 of FIG. 2.
Figure 5:
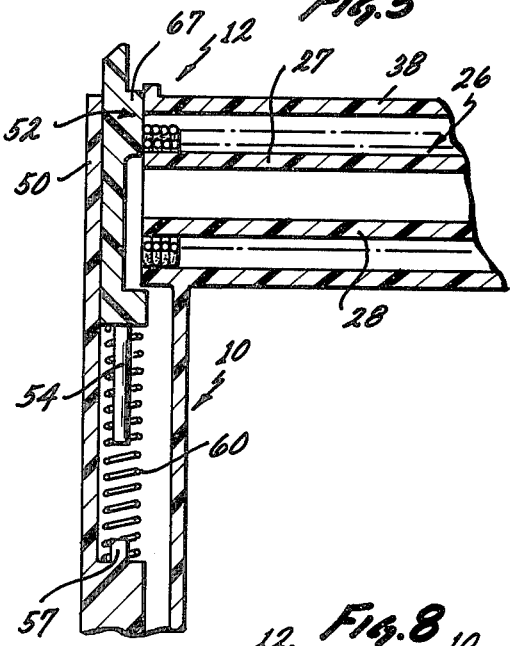
FIG. 5 is a partial sectional view like that of FIG. 2 showing the pin feeder in one position.

Referring to the drawings a preferred form of the tool is shown having a contoured grip or handle 10 extending below a chamber for pin-hooks as designated at 12. The grip 10 is at angle of substantially 90° with respect to the chamber 12 for reasons which will be explained.

The grip or handle 10 is shaped to fit the hand. The chamber 12 has a cross sectional shape as may be seen in FIG. 3. The tool may be constructed entirely from plastic material by way of a plastic injection molding process. As shown in FIG. 3, the chamber 12 is generally rectangular in cross section. The chamber is preferably injection molded of polypropylene or similar polyolefin plastic. The chamber door and hinge are molded as an integral unit. At one side of the chamber is the door 16 which is hinge by way of a hinge 18 which is part of the integral material. When closed, the door may be held closed by latch hooks 22 and 22' that hook over projections 23 and 23' on the top of the housing 12. The latch means are exemplary of types of latches that may be used.

As shown, the chamber 12 has extending inwardly from one side a somewhat U-shaped projection or formation as designated at 26 having sides 27 and 28 which come together in a pointed configuration 30. The U-shaped member of projection 26 has an exterior contour which conforms to the contour of the hook part of a pin-hook as designated at 34. The pin-hook fits over the pointed end 30 of the member 26.

On the inside of the door there is formed a projecting portion or a boss as designated at 36 the inside contour of which is such as to conform to the outside contour of the pin-hook as shown. The wall 27 of the member 26 is spaced from the top 38 of the chamber 12 to leave space to be occupied by the pointed part and the eye of the pin-hook 34. Thus, as may be seen, when the door 16 is closed, a row or a charge of pin-hooks is held by the member 26 and the door 16. They are confined in a vertical space with sufficient clearance to allow them to slide easily, the inside configuration holding them in alignment.

The pin-hooks may be inserted as a group or charge simply by opening the door 16, the pin-hooks being held on a spine or spindle stem 42 as shown in FIG. 1 which is insertable through an opening 44 in the end member 46 of the housing 12.

Figure 7:
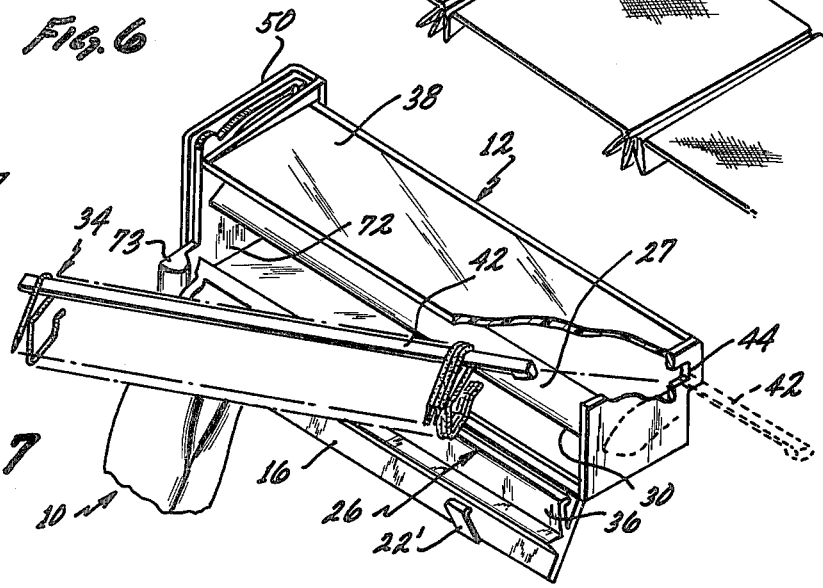
FIG. 7 is an isometric view of the form of the invention of FIGS. 1–6 showing the door of pin-hook chamber open and illustrating the insertion of a charge of pin hooks.

FIG. 7 illustrates the tool with the door 16 open and illustrates a group of pin-hooks on the spine 42 in position for being inserted into the chamber 12. After the pin-hooks have been inserted and the door closed, the spine or spindle 42 can be withdrawn.

The dispensing and inserting end of the tool is at the same end as the handle or grip 10. The handle or grip 10 is hollow as shown. Numeral 50 designates an end plate at the end of the chamber 12 which is spaced from the side walls so as to form a slot for sliding dispenser or ejector member 52.

Extending downwardly from the member 52 is a stem 54. Numeral 57 designates an integral boss inside of the handle 10 having an end projection 57. Numeral 60 designates a coil biasing spring held by the stem 54 at one end and by the projection 57 at the other. The spring 60 biases the member 52 upwardly.

The member 52 is configurated to have a boss 67 on the inside thereof so as to receive pin-hooks from the chamber 12 that feed by gravity against member 52. The boss as designated at 67 is in a form on the insde surface of the member 52 to have boss 67 come into a position within the U-shaped part of an individual pin-hook, one of which is designated at 70 in FIG. 1.

The member 52 has a depending part 72 the end of which is of rounded conformation as shown at 73 which is positioned to be actuatable by the users thumb when the handle 10 is being gripped by the hand.

Figure 6:
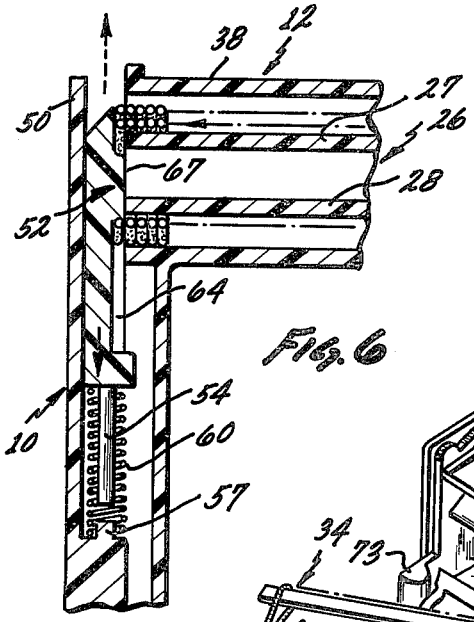
FIG. 6 is a partial sectional view like that of FIG. 5 showing the pin hook feeder in receiving position.
Figure 8:
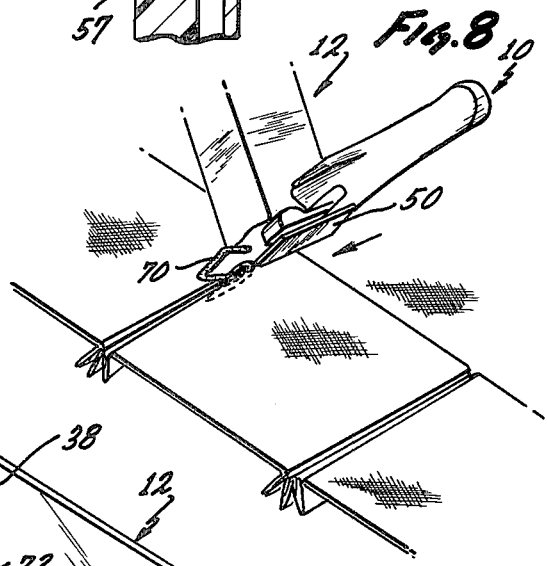
FIG. 8 is an isometric view illustrating utilization of the tool.

With respect to the operation and utilization of the tool as stated, it can be gripped in the hand so that the trigger 73 is operable by the thumb. The operation is illustrated in FIGS. 4–8. When the member 52 is retracted by pressure on the trigger member 73 against the spring 60, the boss 67 comes into a position to receive a single pin-hook 70 which is fed by gravity from the chamber 12. A pin-hook becomes positioned in the ejector or dispenser member 52 when it is moved downwardly from a position shown in FIG. 5 to a position as shown in FIG. 6. When pressure on the trigger 73 is released the spring 60 moves the member 52 transversely as illustrated in FIGS. 2 and 3 so that the pointed end of the pin-hook is in a position where it can be inserted into the drapery material as illustrated in FIG. 8. Then the tool is moved in a direction away from the pointed end of the pin-hook so that the pin-hook emerges relatively sideways from the slot between the end plate 50 and the chamber 12 as may be seen in FIGS. 1 and 4.

The utilization of the tool is illustrated in FIG. 8.

The capacity of the pin chamber is 25% or more greater with the same length of pin chamber. In prior art tools that use a pin rack or a magazine, this adds to the bulkiness, these parts taking up appreciable space which in the tool of the herein invention is available for pin storage. The tool does not have to be loaded as frequently saving the user time.

From the foregoing those skilled in the art will readily understand the nature and construction of the invention, its utilization, and the manner in which it achieves and realizes all of the other objects of the invention heretofore referred to.

The foregoing disclosure is representative of a preferred form of the invention and is to be interpreted in an illustrative rather than a limiting sense, the invention to be accorded the full scope of the claims appended hereto.

I claim:

1. A drapery pin-hook dispensing and inserting tool including, in combination, means forming a chamber for holding pin-hooks, means carried by the said chamber means for ejecting individual pin-hooks to be inserted in drapery from an end of the chamber, the chamber means being provided with an opening lengthwise of the chamber of a size whereby a group of pin-hooks arranged in alignment on a spindle can be inserted into the chamber means in a position to feed to the ejector means, the chamber being free from a removable magazine part said chamber means having an internal construction contoured to conform to the shape of the pin-hooks whereby to hold and guide them in travelling toward the ejection means after removal of said spindle.

2. A tool as in claim 1 wherein the said internal construction in the chamber means includes a projection extending along the length of the chamber means and having an external shape to conform to the shape of a part of the pin-hooks.

3. A tool as in claim 1 wherein the ejector means includes a manually reciprocating member movable from a position in which it receives a pin-hook from the chamber means to a position for ejecting a pin-hook.

4. A tool as in claim 3 wherein the chamber means is provided with a grip the ejector means having an actuating trigger positioned to be manually actuated in association with the grip.

5. A tool as in claim 4 where in the grip is positioned at an angle of substantially 90° with respect to the chamber means to facilitate insertion of pin-hooks into drapery when ejected from the chamber means.

6. A drapery pin-hook dispensing and inserting tool including in combination, means forming a chamber for holding pin-hooks, means carried by the said chamber means for ejecting individual pin-hooks to be inserted in drapery, the chamber means being provided with an opening of a size whereby a group of pin-hooks arranged in alignment can be inserted into the chamber means in position to feed to the ejector means, the said chamber means having an internal construction contoured to conform to the shape of the pin-hooks whereby to hold and guide them in traveling toward the ejection means, the said internal construction in the chamber means including a projection extending along the length of the chamber means and having an external shape to conform to the shape of a part of the pin-hooks, the chamber means including a closure member, the closure member having means formed on the interior thereof provided with a contour to conform to the contour of a part of the pin-hooks to assist in holding and guiding the pin-hooks in moving toward the ejector means.

7. A tool as in claim 6 wherein the closure member is constructed to be opened to expose the said projection extending along the length of the chamber means whereby a charge of spindled pin-hooks can be placed on the projection and the closure member can then be closed so that its interior comes adjacent to the pin-hooks.

8. A tool as in claim 7 wherein the closure member is in the form of a hinged door constructed whereby when opened it provides an opening along the length of the chamber.

9. A tool as in claim 8 wherein the chamber has an opening adapted to receive a spindle stem whereby a spindle stem can be withdrawn from a charge of pin-hooks positioned in the chamber.

* * * * *